US007363981B2

(12) United States Patent
Coon et al.

(10) Patent No.: US 7,363,981 B2
(45) Date of Patent: Apr. 29, 2008

(54) SEAL STACK FOR SLIDING SLEEVE

(75) Inventors: Robert Coon, Missouri City, TX (US); Khai Tran, Pearland, TX (US); Antonio Flores, Houston, TX (US); Charles Wintill, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 34 days.

(21) Appl. No.: 10/748,695

(22) Filed: Dec. 30, 2003

(65) Prior Publication Data

US 2005/0139362 A1 Jun. 30, 2005

(51) Int. Cl.
*E21B 34/14* (2006.01)

(52) U.S. Cl. ..... 166/334.4; 166/332.1; 166/373; 166/386; 166/387; 277/342

(58) Field of Classification Search ..... 166/386, 166/387, 334.4, 332.1, 373; 277/530, 533, 277/50, 342

See application file for complete search history.

(56) References Cited

U.S. PATENT DOCUMENTS 2,317,021 A * 4/1943 Bassinger ..... 166/332.6
2,888,080 A * 5/1959 Tausch et al. ..... 166/114
3,051,243 A * 8/1962 Grimmer et al. ..... 166/332.7
3,071,193 A 1/1963 Raulins
3,151,681 A * 10/1964 Chudleigh ..... 166/332.4
3,395,758 A 8/1968 Kelly et al.
3,414,060 A 12/1968 Zak
3,773,441 A * 11/1973 Schertz ..... 417/554
4,532,987 A * 8/1985 Reed ..... 166/75.14
4,971,099 A 11/1990 Cyvas
5,156,220 A 10/1992 Forehand et al.
5,263,683 A 11/1993 Wong
5,299,640 A 4/1994 Streich et al.
5,309,993 A * 5/1994 Coon et al. ..... 166/115
5,316,084 A 5/1994 Murray et al.
5,443,129 A 8/1995 Bailey et al.
5,611,547 A * 3/1997 Baugh et al. ..... 277/336
5,718,289 A 2/1998 Schnatzmeyer et al.
5,896,928 A 4/1999 Coon (Continued)

FOREIGN PATENT DOCUMENTS

EP 893 575 1/1999

(Continued)

OTHER PUBLICATIONS

EP Search Report, Application No. EP 04030243, dated Mar. 9, 2005.
EP Search Report, Application No. 06123780.6-2315, dated Feb. 5, 2007.

*Primary Examiner*—Giovanna C Wright
(74) *Attorney, Agent, or Firm*—Patterson & Sheridan, L.L.P.

(57) ABSTRACT

A method and apparatus for sealing a tool for use in a wellbore is provided. The seal is configured to be disposed in a tool comprising a ported sliding sleeve and a ported housing. The tool may be actuable between a closed and an open position. The seal is configured so that one side of the seal acts as a flow restrictor to protect the other side of the seal from damage during actuation of the tool under pressurized conditions.

37 Claims, 4 Drawing Sheets

U.S. PATENT DOCUMENTS

| | | | |
|---|---|---|---|
| 5,906,238 | A | 5/1999 | Carmody et al. |
| 5,957,207 | A | 9/1999 | Schnatzmeyer |
| 5,957,208 | A | 9/1999 | Schnatzmeyer |
| 5,979,558 | A | 11/1999 | Bouldin et al. |
| 6,041,857 | A | 3/2000 | Carmody et al. |
| 6,044,908 | A | 4/2000 | Wyatt |
| 6,070,670 | A | 6/2000 | Carter et al. |
| 6,082,458 | A | 7/2000 | Schnatzmeyer |
| 6,112,816 | A | 9/2000 | Orzechowski et al. |
| 6,253,850 | B1 | 7/2001 | Nazzai et al. |
| 6,260,616 | B1 | 7/2001 | Carmody et al. |
| 6,276,458 | B1 | 8/2001 | Malone et al. |
| 6,293,344 | B1 | 9/2001 | Nixon et al. |
| 6,308,783 | B2 | 10/2001 | Pringle et al. |
| 6,318,729 | B1 | 11/2001 | Pitts, Jr. et al. |
| 6,328,112 | B1 | 12/2001 | Malone |
| 6,328,729 | B1 | 12/2001 | Jervis |
| 6,334,486 | B1 | 1/2002 | Carmody et al. |
| 6,422,317 | B1 | 7/2002 | Williamson, Jr. |
| 6,434,651 | B1 | 8/2002 | Gentry, Jr. |
| 6,446,729 | B1 | 9/2002 | Bixeman et al. |
| 6,450,225 | B2 | 9/2002 | Yukawa et al. |
| 6,484,800 | B2 | 11/2002 | Carmody et al. |
| 6,494,265 | B2 | 12/2002 | Wilson et al. |
| 6,513,599 | B1 | 2/2003 | Bixenman et al. |
| 6,516,688 | B2 | 2/2003 | Gunnarson et al. |
| 6,575,243 | B2 | 6/2003 | Pabst |
| 6,612,547 | B2 | 9/2003 | Carmody et al. |
| 6,668,935 | B1 | 12/2003 | McLoughlin et al. |
| 6,715,558 | B2 | 4/2004 | Williamson |
| 6,722,439 | B2 | 4/2004 | Garay et al. |
| 6,860,330 | B2 * | 3/2005 | Jackson ..... 166/332.1 |
| 6,869,063 | B2 | 3/2005 | Gunnarson et al. |
| 6,880,638 | B2 | 4/2005 | Haughom et al. |
| 6,966,380 | B2 | 11/2005 | McLoughlin et al. |
| 6,973,974 | B2 | 12/2005 | McLoughlin et al. |
| 2003/0056951 | A1 | 3/2003 | Kaszuba |
| 2003/0159832 | A1 | 8/2003 | Williamson |
| 2004/0041120 | A1 | 3/2004 | Haughom et al. |
| 2004/0129431 | A1 | 7/2004 | Jackson |
| 2005/0263279 | A1 | 12/2005 | Vachon |

FOREIGN PATENT DOCUMENTS

| | | |
|---|---|---|
| WO | WO 00/75484 | 12/2000 |
| WO | WO 00/79094 | 12/2000 |
| WO | WO 01/21935 | 3/2001 |
| WO | WO 02/16730 | 2/2002 |

* cited by examiner

SEAL STACK FOR SLIDING SLEEVE

BACKGROUND OF THE INVENTION

1. Field of the Invention

Embodiments of the present invention generally relate to a novel seal assembly for use in a wellbore tool. An upper end of the seal assembly acts as a flow restrictor protecting a lower end of the seal assembly from high pressure and/or high volume flow.

2. Description of the Related Art

Subsequent to the drilling of an oil or gas well, it is completed by running into such well a string of casing which is cemented in place. Thereafter, the casing is perforated to permit the fluid hydrocarbons to flow into the interior of the casing and subsequently to the top of the well. Such produced hydrocarbons are transmitted from the production zone of the well through a production tubing or work string which is concentrically disposed relative to the casing.

In many well completion operations, it frequently occurs that it is desirable, either during the completion, production, or workover stages of the life of the well, to have fluid communication between the annular area between the interior of the casing and the exterior of the production tubing or workstring with the interior of such production tubing or workstring for purposes of, for example, injecting chemical inhibitor, stimulants, or the like, which are introduced from the top of the well through the production tubing or workstring and to such annular area. Alternatively, it may be desirable to provide such a fluid flow passageway between the tubing/casing annulus and the interior of the production tubing so that actual production fluids may flow from the annular area to the interior of the production tubing, thence to the top of the well. Likewise, it may be desirable to circulate weighting materials or fluids, or the like, down from the top of the well in the tubing/casing annulus, thence into the interior of the production tubing for circulation to the top of the well in a "reverse circulation" pattern.

In instances as above described, it is well known in the industry to provide a well tool having a port or ports therethrough which are selectively opened and closed by means of a "sliding" sleeve element positioned interiorly of the well tool. Such sleeve typically may be manipulated between open and closed positions by means of wireline, remedial coiled tubing, electric line, or any other well known auxiliary conduit and tool means.

Typically, such ported well tools will have upper and lower threaded ends, which, in order to assure sealing integrity, must contain some sort of elastomeric or metallic sealing element disposed in concert with the threads to prevent fluid communication across the male/female components making up the threaded section or joint. A placement of such a static seal represents a possible location of a seal failure and, as such, such failure could adversely effect the sealing integrity of the entire production tubing conduit.

Additionally, in such well tools, a series of upper and lower primary seals are placed in the housing for dynamic sealing engagement relative to the exterior of a sleeve which passes across the seals during opening and closing of the port element. As with all seals, such primary sealing means also represent an area of possible loss of sealing integrity.

During movement of the sleeve to open the port in such well tool to permit fluid communication between the interior and exterior thereof, such primary seals positioned between the interior wall of the well tool housing and the exterior wall of the shifting sleeve will first be exposed to a surge of fluid flow which can cause actual cutting of the primary seal elements as pressure is equalized before a full positive opening of the sleeve and, in some instances, during complete opening of the sleeve. In any event, any time such primary seals are exposed to flow surging, such primary seals being dynamic seals, a leak path could be formed through said primary seals.

Accordingly, there is a need for a well tool wherein the leak paths are reduced, thus greatly reducing the chances of loss of sealing integrity through the tool and the tubular conduit. Secondly, there is a need for a well tool in which sensitive areas of the primary seal element are protected by substantially blocking fluid flow thereacross during shifting of the sleeve element between open and closed positions.

SUMMARY OF THE INVENTION

The present invention generally relates to a novel seal assembly for use in a wellbore tool. An upper end of the seal assembly acts as a flow restrictor protecting a lower end of the seal assembly from high pressure and/or high volume flow.

In one aspect, a tool for use in a wellbore is provided, comprising a tubular housing having a bore therethrough and at least one flow port disposed through a wall thereof; a sleeve slidably mounted within the housing, wherein the sleeve has a bore therethrough and at least one flow slot disposed through a wall thereof, the at least one slot selectively alignable with the at least one flow port; and a seal assembly disposed between the housing and the sleeve, wherein the seal assembly is configured so that a first portion of the seal assembly protects a second portion of the seal assembly from substantial damage during actuation of the tool. Preferably, the seal assembly comprises a center adapter. Preferably, either the length of the center adapter or that of the seal assembly substantially corresponds to the length of the sleeve flow slot and the center adapter comprises a plurality of protrusions disposed around both an inner side and an outer side thereof. Preferably, the seal assembly further comprises a first end adapter; a second end adapter, wherein the center adapter is disposed between the two end adapters; at least one first sealing element disposed between the first end adapter and the center adapter; and at least one second sealing element disposed between the second end adapter and the center adapter.

In another aspect, a seal assembly for use in a wellbore tool is provided, comprising a first end adapter; a second end adapter; a center adapter disposed between the two end adapters; at least one first sealing element disposed between the first end adapter and the center adapter; and at least one second sealing element disposed between the second end adapter and the center adapter, wherein the length of the seal assembly substantially corresponds to a length of a sleeve flow slot of the wellbore tool. Preferably, a plurality of protrusions are disposed around both sides of the center adapter.

In yet another aspect, a seal assembly for use in a wellbore tool is provided, comprising a tubular housing having a bore therethrough and at least one flow port disposed through a wall thereof; a sleeve slidably mounted within the housing, wherein the sleeve has a bore therethrough and at least one flow slot disposed through a wall thereof, the at least one slot selectively alignable with the at least one flow port; and a seal assembly comprising a center adapter, wherein the center adapter includes a structure configured for limiting fluid flow across the seal assembly during actuation of the tool.

In yet another aspect, a method of using a wellbore tool is provided, comprising providing the wellbore tool, wherein the tool comprises a tubular housing having a bore therethrough and at least one flow port disposed through a wall thereof; a sleeve slidably mounted within the housing, wherein the sleeve has a bore therethrough and at least one flow slot disposed through a wall thereof; and a seal assembly disposed between the housing and the sleeve; running the wellbore tool into a pressurized wellbore; and sliding the sleeve over the seal assembly, wherein a first portion of the seal assembly will restrict flow of pressurized fluid to a second portion of the seal assembly so that the second portion is not substantially damaged during sliding of the sleeve.

In yet another aspect, a method of using a wellbore tool is provided, comprising providing the wellbore tool, wherein the tool comprises a tubular housing having a bore therethrough and at least one flow port disposed through a wall thereof; a sleeve slidably mounted within the housing, wherein the sleeve has a bore therethrough and at least one flow slot disposed through a wall thereof; a seal assembly comprising a center adapter, wherein the center adapter includes a structure; running the wellbore tool into a pressurized wellbore; and sliding the sleeve over the seal assembly, wherein the structure of the center adapter will limit fluid flow across the seal assembly so that the seal assembly is not substantially damaged during sliding of the sleeve.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figures 1A, 1B, 1C:
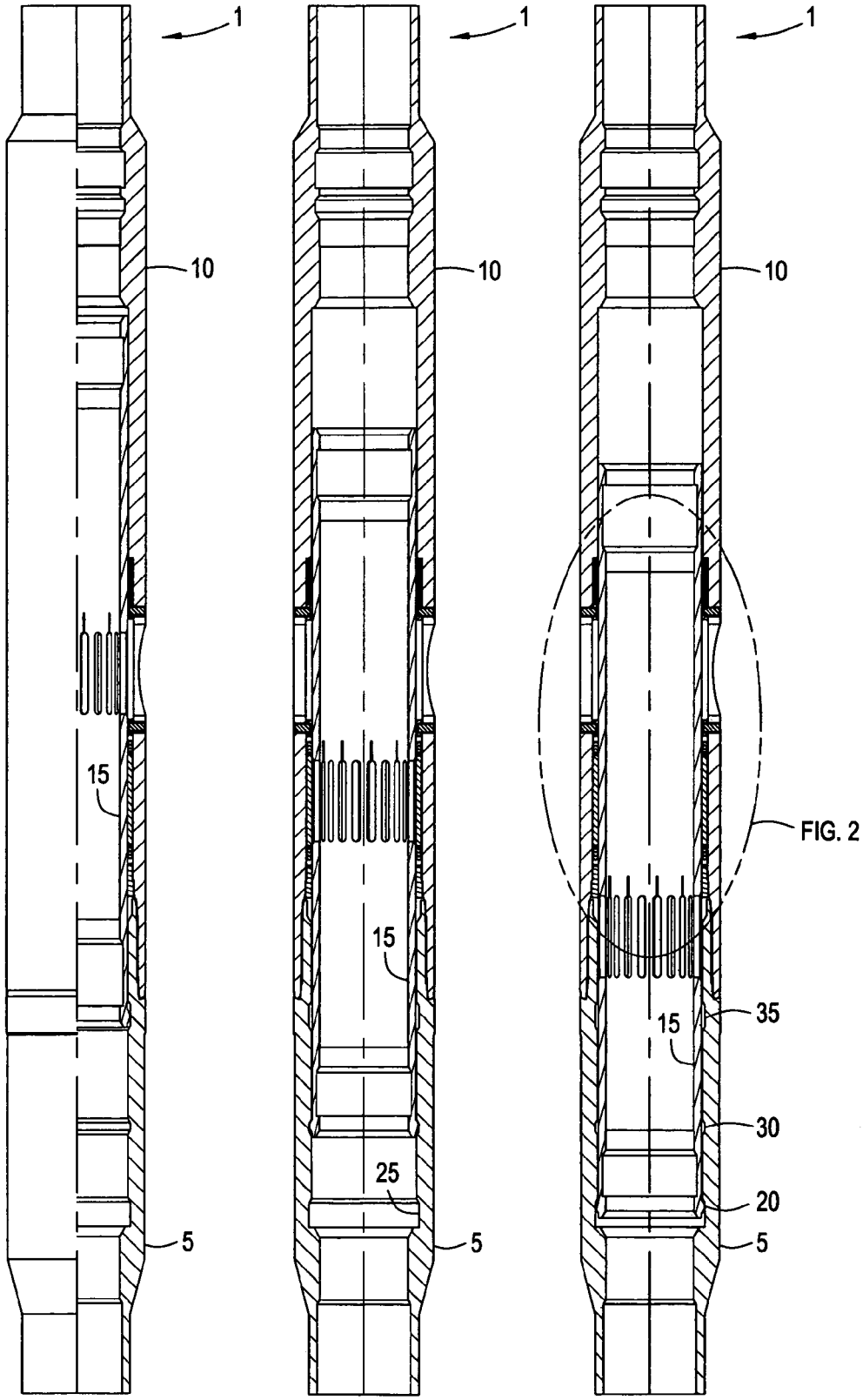
FIG. 1A is a sectional view of a wellbore tool in a closed position.
FIG. 1B is a sectional view of the wellbore tool in an intermediate pressure equalization position.
FIG. 1C is a partial sectional view of the wellbore tool in an open position.

FIGS. 1A-1C are (1C partial) sectional views of a welibore tool 1 in its three actuatable positions: closed, equalization, and open, respectively. The wellbore tool 1 first comprises an upper housing 10. The upper housing 10 is a tubular member with a flow bore therethrough. At a top end, the upper housing 10 is threaded for connection with a production string, workstring, or members thereof (not shown). At a bottom end, the upper housing 10 is threadedly connected to a lower housing 5. The lower housing contains a lip (see FIG. 3) at a top end that deforms against a tapered inside surface of the upper housing 10 when the two housings are connected, thereby forming a metal-to-metal seal. The lower housing 5 is a tubular member with a flow bore therethrough. At a bottom end, the lower housing 5 is threaded for connection with a production string, workstring, or members thereof (not shown). Concentrically disposed within the upper housing 10 and the lower housing 5 is a sleeve 15. The sleeve 15 is a tubular member with a flow bore therethrough. A top end of the sleeve 15 is configured to form a shifting neck for receiving a shifting tool (not shown). The shifting tool may be run in on a wireline, coiled tubing, or other means. Once the shifting tool has engaged with the shifting neck, an actuation force may be exerted on the sleeve 15. Alternatively, a lower end of the sleeve 15 proximate a latch 20 (see below) is also configured to form a shifting neck. The tool 1 may also be used upside down.

Three retainer grooves: upper groove 35, middle groove 30, and lower groove 25 are formed in a wall on an inner side of the lower housing 5. The three grooves 25, 30, and 35 correspond to the three positions of the tool 1: closed, equalization, and open, respectively. A latch 20 is formed integrally with and extends outward from a lower side of the sleeve 15. In FIG. 1A, the latch 20 retains the sleeve 15 in the closed position. When it is desired to actuate the tool 1, an upward actuating force will be applied to the sleeve 5. This force will cause the latch member 20 to be compressed by an inner wall of the lower housing 5. This will allow the sleeve to slide relative to the upper housing 10 and the lower housing 5 which is held in place by the workstring or an anchor (not shown). Once the sleeve is slid so that the latch 20 of the sleeve 15 is aligned with the middle groove 30 of the lower housing 5, the latch will engage the middle grove 30. The sleeve 15 will then be retained in the equalization position of the tool 1 (see FIG. 1B). The process may then be repeated to actuate the tool 1 into an open position (see FIG. 1C). The actuating force may be reversed to actuate the tool back to the equalization position and then again back to the open position. Alternatively, a retainer groove (not shown) may be formed in a wall on a lower side of the sleeve 15 instead of the latch 20. A latch ring (not shown) may then be disposed between the retainer groove of the sleeve and the lower groove 25 (in the closed position) of the upper housing 5. The actuation force would then cause the latch ring to be compressed within the retainer groove of the sleeve 15 during actuation of the sleeve.

Formed proximately below the groove 25 in the lower housing 5 is a shoulder. A corresponding shoulder (see FIG. 1) is formed in the upper housing 10. These two shoulders form rigid barriers to sliding of the sleeve in case of failure of the latch member 20 or operator error in applying the actuation force so that the sleeve 5 does not escape the confines of the tool 1.

Figure 2:
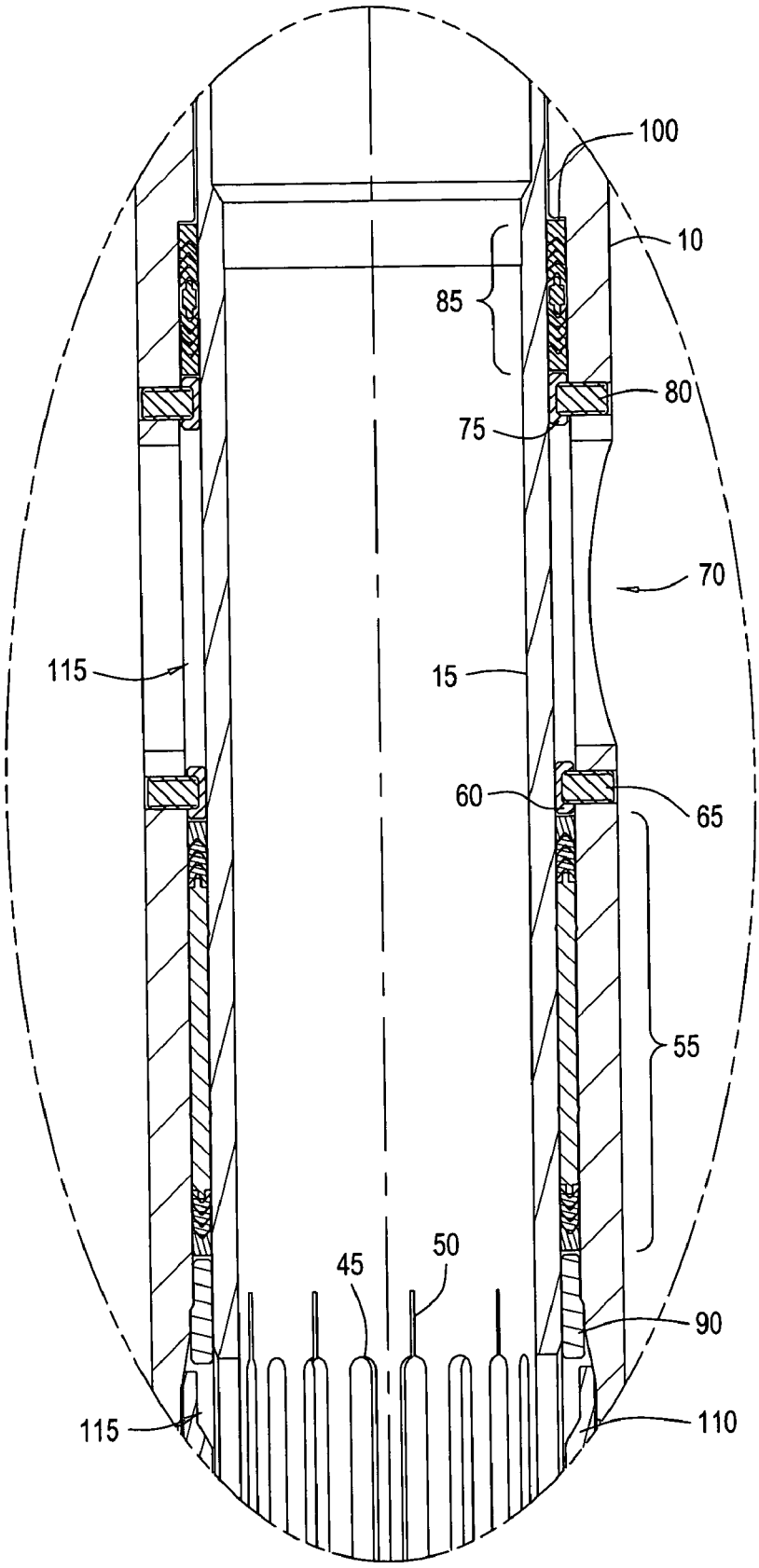
FIG. 2 is an enlarged view of a central portion of FIG. 1A displaying sealing features of the wellbore tool.

Referring now to FIG. 2, two flow ports 70 are disposed through a wall of the upper housing 10. A seal recess 115 is disposed along an inner side of the upper housing 10. At a bottom end, the seal recess 115 is bounded by an upper end 110 of the lower housing 5. At a top end, the seal recess 115 is bounded by a shoulder 100 of the upper housing 10. Disposed within the seal space 115 is a lower primary seal retainer 90. The retainer 90 is restrained from sliding up the seal space by a shoulder that mates with a corresponding shoulder of the upper housing 10. The retainer 90 is restrained from sliding downward by the upper end 110 of the lower housing 5. Disposed in the seal space 115 proximately below the flow port 70 is an upper primary seal retainer 60. The retainer 60 has a groove for seating a retainer screw 65 which is threadedly engaged to a corresponding hole formed through the upper housing 10. Disposed in the seal space 115 between the two retainers 90, 60 is a primary seal assembly 55. Disposed in the seal space 115 proximately above the flow port 70 is a secondary seal retainer 75. Like the upper primary seal retainer 60, the retainer 75 has a groove for seating a retainer screw 80 which is threadedly engaged to a corresponding hole formed through the upper housing 10. Disposed in the seal space 115 between the retainer 75 and the shoulder 100 is a secondary seal assembly 85. Alternatively, the retainer screws 65, 80 and their corresponding holes through the upper housing 10 may be replaced by retainer rings (not shown). Grooves (not shown) would be formed in an inner wall of upper housing 10 instead of the holes. The retainer rings would then seat in the grooves formed in retainers 60, 75 and the grooves formed in the inner wall of the upper housing 10. Alternatively, further, flow ports 70 could be extended axially along the tool, by adding slots, to correspond to the retainers 60, 75 and the retainer rings could be ring portions with J-hooks at each of their ends to secure the retainer rings to the upper housing 10.

Disposed through a wall of the sleeve 15 are a flow port 45 and an equalization port 50. Both ports 45 and 50 comprise a series of slots disposed around the sleeve 15. The slots of the equalization port 50 are smaller in comparison to the slots of the flow port 45. Thus, under the same pressure the flow capacity of the equalization port 50 is less than that of the flow port 45.

Figure 3:
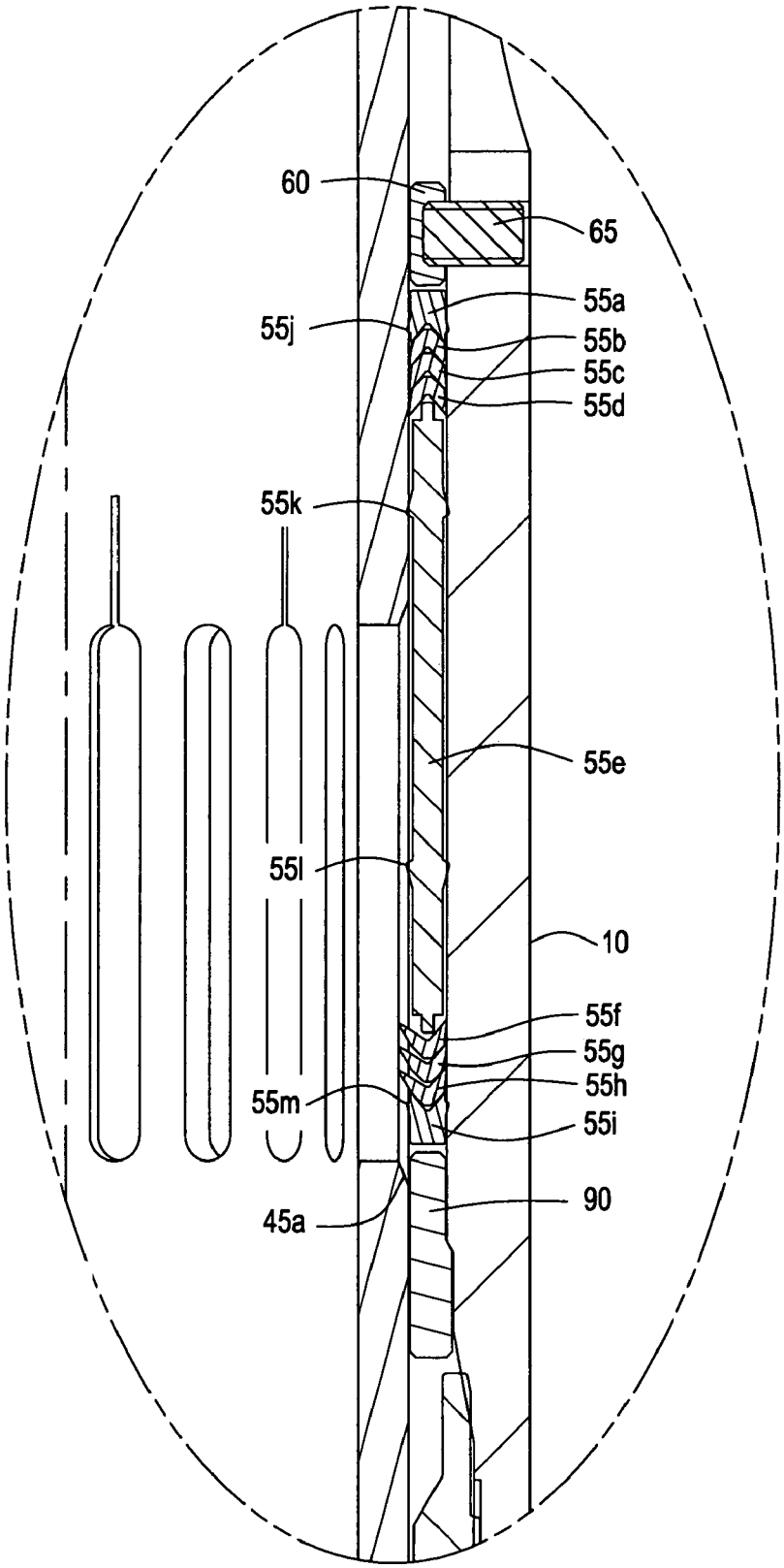
FIG. 3 is an enlarged view of a primary seal assembly displayed in an intermediate position of the tool between the positions displayed in FIG. 1A and FIG. 1B.

FIG. 3 illustrates an enlarged view of the primary seal assembly 55. The seal assembly 55 first comprises an upper 55*a* and a lower 55*i* end adapter. The seal assembly further comprises a center adapter 55*e*. Three Chevron-shaped, upper sealing elements 55*b-d* are disposed between the upper end adapter 55*a* and the center adapter 55*e*. Likewise, three Chevron-shaped, lower sealing elements 55*f-h* are disposed between the center adapter 55*e* and the lower end adapter 55*i*. The sealing elements 55*b-d*, 55*f-h* disposed above and below the center adapter 55*e* are subjected to an axial compressive force which flares the sealing elements radially outward slightly to engage, on one side, the upper housing 10, and to engage, on the other side, sleeve 15. Each sealing element is equipped with one male end and one female end. Each female end is equipped with a central cavity which is adapted for receiving other male ends. The center adapter 55*e* is equipped with two male ends and each end adapter is equipped with one female end. As shown, seal elements 55*b-d* and 55*f-h* are substantially identical. Alternatively, there may be variations in the shape of each of elements 55*b-d* and 55*f-h*. Alternatively, further, the male ends of center adapter 55*e* may be lengthened and the female ends of elements 55*d, f* may be lengthened to surround the male ends of center adapter 55*e*.

The adapters 55*a,e,i* may be made of any substantially hard nonelastomeric material, such as a thermoplastic polymer, or they may be made of metal. Examples of a suitable thermoplastic polymer are Polyetheretherkeytone (PEEK), PEK, PEKK, or any combination of PEEK, PEK, and PEKK. The sealing elements 55*b-d* and 55*f-h* may also be made of a thermoplastic polymer or they may be made of an elastomer. Preferably, the adapters 55*a,e,i* are constructed from a relatively hard material as compared to a preferable soft material of the sealing elements 55*b-d* and 55*f-h*. Examples of the relatively soft material are TEFLON (DuPont Trademark) and rubber.

The adapters 55*a,e,i* comprise protrusions 55*j-m*. The center adapter 55*e* has been narrowed and the protrusions 55*k,l* have been exaggerated for the purpose of illustration. Each protrusion is disposed around both an inner side and an outer side of the adapters 55*a,e,i*. Preferably, the protrusions 55*j-m* are formed such that their cross-sections are substantially in the shape of a right-triangle, however, other cross-sectional shapes will suffice. The protrusions 55*j,k* are oriented such that the hypotenuse of each faces the upper end of the tool. Conversely, the protrusions 551*l-m* are oriented such that the hypotenuse of each faces the lower end of the tool. However, any orientation of the protrusions 55*j-m* should suffice. Alternately, the protrusions 55*j-m* may be disposed around only one side of the adapters 55*a,e,i*. If the adapters 55*a,e,i* are constructed from metal, protrusions 55*j-m* may be disposed as separate softer pieces within grooves (not shown) formed in the adapters 55*a,e,i*. A preferred configuration of seal assembly 55 is shown, however, the number of protrusions may be varied according to the design requirements of the seal assembly. Also, protrusions may be disposed around only the end adapter 55*a* or around only the center adapter 55*e*. Further, there may be no protrusions at all. The secondary seal assembly 85 may be a conventional packing stack which is well known in the art so it will not be discussed in detail.

Figure 4:
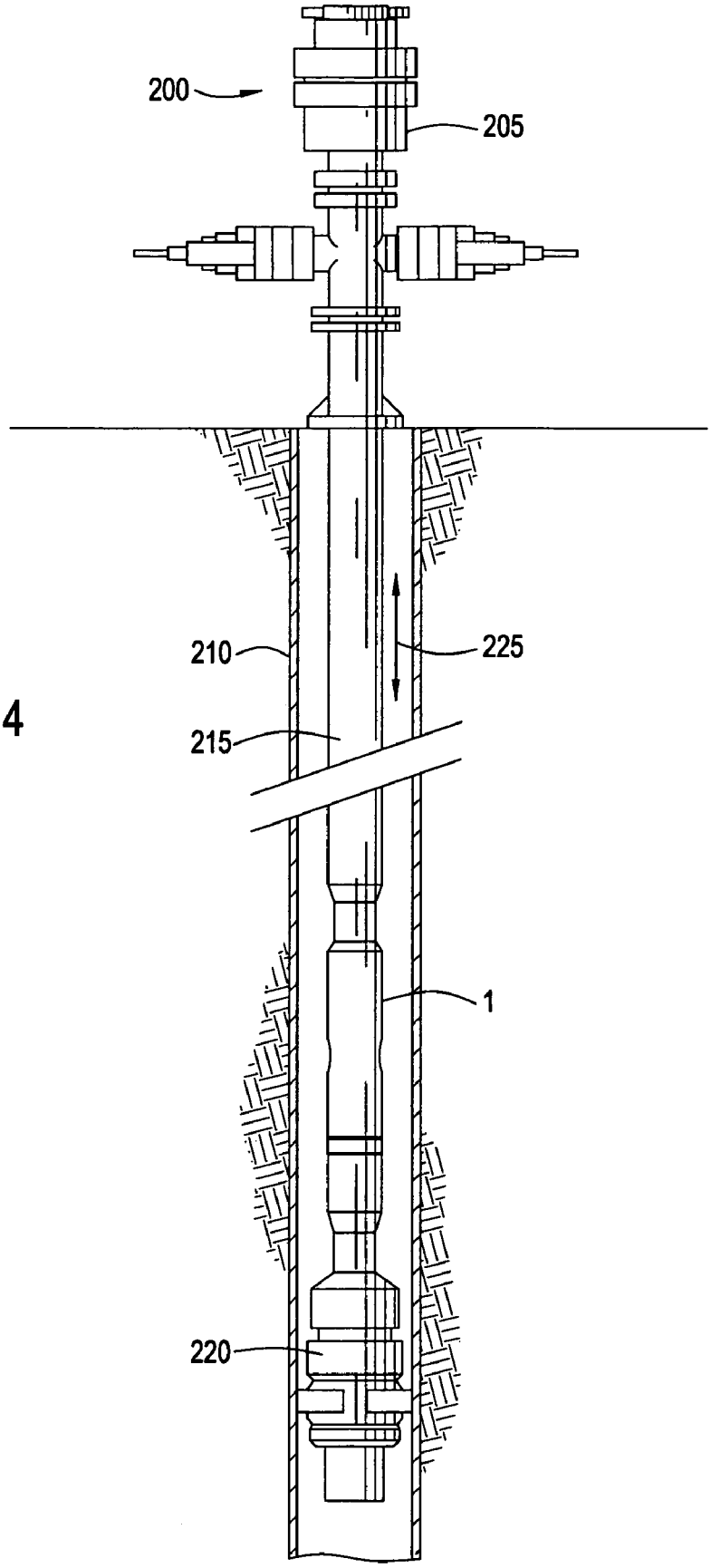
FIG. 4 is a longitudinal sectional view of a subterranean well showing the well tool positioned above a well packer inside the well.

Operation of the tool 1 is as follows. Referring to FIG. 4, the tool 1 of the present invention is assembled within a workstring or production string. The workstring or production string may comprise one or two packers and other well tools. The workstring or production string is lowered into a cased wellbore containing pressurized fluid. The tool 1 is usually in a closed position (see FIG. 1A) when run in to the wellbore, however, it can also be run in an open position (see FIG. 1C). When run-in closed, the outside of the tool 1 will be exposed to the wellbore pressure Ph. Typically, the inside of the tool will be at a lower pressure Pl. Roughly, a lower end of the seal assembly 55 will be at Pl, while an upper end will be at Ph. Referring to FIG. 1A, once the tool 1 is lowered within a pressurized wellbore, pressurized fluid will enter the flow ports 70 flow around/through the retainers 65 and 80. The fluid will be prevented from entering the low pressure bore within the sleeve 15 by the primary 55 and secondary 85 seal assemblies. Fluid will be prevented from entering through the coupling between the upper 10 and lower 5 housings by the seal formed by the lip of the lower housing 5 and the tapered section of the upper housing 10.

At some point, it will be desired to actuate the sleeve 15. As the sleeve is being actuated from the closed position (FIG. 1A) to the equalization position (FIG. 1B), the equalization port 50 will expose the interior of the tool to pressure increasing from Pl to Ph. Referring to FIG. 3, when the flow port 45 passes under the lower sealing elements 55*f-h*, the ends of the elements will expand into the port. It is at this point where the lower sealing elements 55*f-h* are at the greatest risk of being damaged. If there is a substantial pressure drop across the lower sealing elements 55*f-h* when a back lip 45*a* of the flow port 45 passes under them, the higher pressure acting on the expanded ends of seal elements will not allow the lower sealing elements to be compressed back into the seal space 115. Instead, the back lip will shear material off of the ends of the lower sealing elements 55*f-h*. Inevitably, this will shorten the useful life of the seal assembly 55. This deleterious effect will be prevented by the design of seal assembly 55. FIG. 3 exhibits the sleeve 15 in an intermediate position between the closed position (FIG. 1A) and the equalization position (FIG. 1B), just before the back lip 45*a* of the sleeve will pass over the extended ends of the lower sealing elements 55*f-h*. In order for the pressurized fluid from the wellbore to reach the expanded ends of the lower sealing elements 55*f-h*, it must first flow around the upper end adapter 55*a* with protrusion 55*j*, sealing elements 55*b-d*, and center adapter 55*e* with protrusions 55*k,l*. In order for the fluid to flow around sealing elements 55*b-d*, it must expend energy to compress them. Additionally, the protrusions 55*j-l* will serve as choke points, further removing energy from the high pressure wellbore fluid. Thus, members 55*a-e* and 55*j-l* of the seal assembly 55 serve as flow restrictors protecting seal elements 55*f-h* from either high pressure and/or high volume flow. Further, the sleeve 15 will safely pass over the expanded ends of seal elements 55*f-h* compressing them back into seal space 115 rather than damaging them.

The length of the center adapter 55*e* corresponds substantially to that of the flow port 45. However, the length of the center adapter 55*e* may be substantially longer or shorter than that of the flow port 45. If a shorter center adapter 55*e* is desired, more sealing elements may be added so that the overall length of the seal assembly 55 at least substantially corresponds to that of the flow port 45. The correspondence in length between the center adapter 55*e* and the flow port 45 ensures the protective members 55*a-e* of the seal assembly 55 are in position to shield the members 55*f-h* from high pressure and/or high volume flow during the transition between the closed and equalization positions of the tool 1.

FIG. 1B shows the wellbore tool 1 in an equalization position, with equalization port 50 in fluid communication with flow port 70, for receiving fluid from the wellbore into the interior of the tool. In the preferred embodiment, equalization port 50 provides a restricted flow path, which allows for gradual diminishment of the pressure differential between the wellbore and the interior of the tool. Further, in this position, members 55*f-h* are not exposed to sleeve port 45 further ensuring their safety. Finally, as shown in FIG. 1C, the tool 1 is in a flowing mode (open position) of operation. Flow port 45 is in alignment with flow port 70, allowing the fluid to flow from the wellbore to interior of the tool 1.

The seal assembly 55 is shown in wellbore tool 1. However, the seal assembly 55 may be disposed in different tools that serve varying functions in the drilling and completion of a wellbore.

Referring to FIG. 4, there is schematically shown the apparatus of the present invention in a well 225 with a wellhead 200 positioned at the top and a blowout preventor 205 positioned thereon.

It will be appreciated that the apparatus of the present invention may be incorporated on a production string during actual production of the well in which the wellhead 200 will be in the position as shown. Alternatively, the apparatus of the present invention may also be included as a portion of a workstring during the completion or workover operation of the well, with the wellhead 200 being removed and a workover or drilling assembly being positioned relative to the top of the well.

As shown in FIG. 4, the casing 210 extends from the top of the well to the bottom thereof with a cylindrical fluid flow conduit 215 being cylindrically disposed within the casing 210 and carrying at its lowermost end a well packer 220. The well tool 1 is shown being carried on the cylindrical fluid flow conduit 215 above the well packer 220.

While the foregoing is directed to embodiments of the present invention, other and further embodiments of the invention may be devised without departing from the basic scope thereof, and the scope thereof is determined by the claims that follow.

The invention claimed is:

1. A tool for use in a wellbore, comprising:

a tubular housing having a bore therethrough and at least one flow port disposed through a wall thereof;

a sleeve slidably mounted within the housing, wherein the sleeve has a bore therethrough and at least one flow port disposed through a wall thereof, the at least one sleeve flow port selectively alignable with the at least one housing flow port, wherein an entire length of the sleeve flow port substantially corresponds to an entire length of the housing flow port; and a seal assembly disposed between the housing and the sleeve, the seal assembly comprising:

an adapter having an entire length substantially the same or greater than the entire length of the sleeve flow port; and at least one substantially chevron-shaped first sealing element disposed proximate to a first end of the adapter.

2. The tool of claim 1, wherein the adapter comprises at least one protrusion disposed around a side thereof.

3. The tool of claim 1, wherein the adapter comprises at least one protrusion disposed around both an inner side and an outer side thereof.

4. The tool of claim 1, wherein the adapter comprises a plurality of protrusions disposed around both an inner side and an outer side thereof.

5. The tool of claim 1, wherein:

the adapter is a center adapter, and the seal assembly further comprises:

a first end adapter, wherein the first sealing element is disposed between the first end adapter and the center adapter in a first axial orientation;

a second end adapter, wherein the center adapter is disposed between the two end adapters; and at least one second sealing element disposed between the second end adapter and the center adapter in a second axial orientation which is opposite to the first axial orientation.

6. The tool of claim 5, further comprising at least one protrusion disposed around the first end adapter.

7. The tool of claim 1, further comprising at least one equalization port disposed through a wall of the sleeve, wherein the equalization port is substantially smaller than the sleeve flow port.

8. The tool of claim 7, further comprising a means for selectively retaining the sleeve among a closed, an open, and an equalization position.

9. The tool of claim 7, wherein the entire length of the adapter is substantially the same as the length of the sleeve flow port.

10. The tool of claim 1, wherein the housing further comprises an upper housing and a lower housing threadingly coupled together and one of the housings comprises a lip and the other housing comprises a tapered surface so that when the housings are coupled the lip mates with the tapered surface to form a seal.

11. The tool of claim 1, wherein: the sealing element is made from an elastomer and the adapter is made from a thermoplastic or a metal.

12. The tool of claim 1, wherein:

the adapter is a center adapter, the first sealing element is disposed in a first axial orientation, and the seal assembly further comprises at least one substantially chevron-shaped second sealing element disposed proximate a second end of the center adapter which is opposite to the first end in a second axial orientation which is opposite to the first axial orientation.

13. The tool of claim 1, wherein the seal assembly is annular.

14. The tool of claim 1, wherein the first sealing element is in direct contact with the adapter.

15. The tool of claim 1, wherein the sleeve flow ports are longitudinal slots.

16. The tool of claim 1, wherein the entire length of the adapter is greater than a combined length of a rest of the seal assembly.

17. The tool of claim 16, wherein the entire length of the adapter is substantially greater than the combined length of the rest of the seal assembly.

18. The tool of claim 1, wherein the entire length of the adapter is substantially the same or greater than each entire length of each port disposed through the wall of the sleeve.

19. A seal assembly for use in a wellbore tool, comprising:

a first end adapter;

a second end adapter;

a center adapter disposed between the two end adapters;

at least one substantially chevron-shaped first sealing element disposed between the first end adapter and the center adapter in a first axial orientation, wherein the first sealing element in direct contact with the center adapter; and at least one substantially chevron-shaped second sealing element disposed between the second end adapter and the center adapter in a second axial orientation which is opposite to the first axial orientation, wherein the second sealing element is in direct contact with the center adapter, wherein a length of one of the adapters is substantially greater than a combined length of a rest of the seal assembly.

20. The seal assembly of claim 19, wherein a protrusion is disposed around the center adapter.

21. The seal assembly of claim 20, wherein the protrusion is a plurality of protrusions.

22. The seal assembly of claim 19, wherein the adapters are constructed from a relatively hard material and the sealing members are constructed from a relatively soft material.

23. The seal assembly of claim 19, wherein the adapters are constructed of a material selected from a group consisting of a thermoplastic polymer and metal.

24. The seal assembly of claim 19, wherein the sealing elements are constructed of a material selected from a group consisting of an elastomer and a thermoplastic polymer.

25. The seal assembly of claim 19, wherein the sealing elements are made from an elastomer and the adapters are made from a thermoplastic or a metal.

26. The seal assembly of claim 19, wherein the one of the adapters is the center adapter.

27. The seal assembly of claim 19, wherein the adapters and sealing elements are annular.

28. A method of using the wellbore tool as recited in claim 1 in a pressurized wellbore, comprising:

providing the wellbore tool as recited in claim 1;

running the wellbore tool into a pressurized wellbore; and sliding the sleeve over the seal assembly, wherein the adapter will limit fluid flow across the seal assembly so that the seal assembly is not substantially damaged during sliding of the sleeve.

29. A method of using the seal assembly as recited in claim 19 in a pressurized wellbore, comprising:

disposing the seal assembly as recited in claim 19 between a housing and a sleeve of a wellbore tool;

running the wellbore tool into a pressurized wellbore; and sliding the sleeve over the seal assembly, wherein the one of the adapters will limit fluid flow across the seal assembly so that the seal assembly is not substantially damaged during sliding of the sleeve.

30. A tool, utilizing the seal assembly of claim 19, for use in a wellbore, the tool comprising:

a tubular housing having a bore therethrough and at least one flow port disposed through a wall thereof;

a sleeve slidably mounted within the housing, wherein the sleeve has a bore therethrough and at least one flow port disposed through a wall thereof, the at least one sleeve flow port selectively alignable with the at least one housing flow port; and the seal assembly, as recited in claim 19, disposed between the housing and the sleeve.

31. The tool of claim 30, wherein the length of the one of the adapters is substantially the same or greater than a length of the sleeve flow port of the wellbore tool.

32. A tool for use in a wellbore, comprising:

a tubular housing having a bore therethrough and at least one flow port disposed through a wall thereof;

a sleeve slidably mounted within the housing, wherein the sleeve has a bore therethrough and at least one flow port disposed through a wall thereof, the at least one sleeve flow port selectively alignable with the at least one housing flow port, wherein a length of the sleeve flow port substantially corresponds to a length of the housing flow port; and a seal assembly disposed between the housing and the sleeve, the seal assembly comprising:

an adapter having a length substantially the same or greater than the length of the sleeve flow port, wherein the length of the adapter is greater than a combined length of a rest of the seal assembly; and at least one substantially chevron-shaped first sealing element disposed proximate to a first end of the adapter.

33. A seal assembly for use in a wellbore tool, comprising:

a first end adapter;

a second end adapter;

a center adapter disposed between the two end adapters;

at least one substantially chevron-shaped first sealing element disposed between the first end adapter and the center adapter in a first axial orientation, wherein the first sealing element in direct contact with the center adapter; and at least one substantially chevron-shaped second sealing element disposed between the second end adapter and the center adapter in a second axial orientation which is opposite to the first axial orientation, wherein the second sealing element is in direct contact with the center adapter, wherein:

a length of one of the adapters is greater than a combined length of a rest of the seal assembly, and a protrusion is disposed around the center adapter.

34. The seal assembly of claim 33, wherein the protrusion is a plurality of protrusions.

35. A seal assembly for use in a wellbore tool, comprising:

a first end adapter;

a second end adapter;

a center adapter disposed between the two end adapters;

at least one substantially chevron-shaped first sealing element disposed between the first end adapter and the center adapter in a first axial orientation, wherein the first sealing element in direct contact with the center adapter; and at least one substantially chevron-shaped second sealing element disposed between the second end adapter and the center adapter in a second axial orientation which is opposite to the first axial orientation, wherein the second sealing element is in direct contact with the center adapter, wherein a length of the center adapter is greater than a combined length of a rest of the seal assembly.

36. A method of using a seal assembly in a pressurized wellbore, comprising:

providing a wellbore tool, comprising:

a housing;

a sleeve; and a seal assembly disposed between the housing and the sleeve, the seal assembly, comprising a first end adapter;

a second end adapter;

a center adapter disposed between the two end adapters;

at least one substantially chevron-shaped first sealing element disposed between the first end adapter and the center adapter in a first axial orientation, wherein the first sealing element in direct contact with the center adapter; and at least one substantially chevron-shaped second sealing element disposed between the second end adapter and the center adapter in a second axial orientation which is opposite to the first axial orientation, wherein the second sealing element is in direct contact with the center adapter, wherein a length of one of the adapters is greater than a combined length of a rest of the seal assembly;

running the wellbore tool into the pressurized wellbore; and sliding the sleeve over the seal assembly, wherein the one of the adapters will limit fluid flow across the seal assembly so that the seal assembly is not substantially damaged during sliding of the sleeve.

37. A tool for use in a wellbore, comprising:

a tubular housing having a bore therethrough and at least one flow port disposed through a wall thereof;

a sleeve slidably mounted within the housing, wherein the sleeve has a bore therethrough and at least one flow port disposed through a wall thereof, the at least one sleeve flow port selectively alignable with the at least one housing flow port; and a seal assembly, comprising:

a first end adapter;

a second end adapter;

a center adapter disposed between the two end adapters;

at least one substantially chevron-shaped first sealing element disposed between the first end adapter and the center adapter in a first axial orientation, wherein the first sealing element in direct contact with the center adapter; and at least one substantially chevron-shaped second sealing element disposed between the second end adapter and the center adapter in a second axial orientation which is opposite to the first axial orientation, wherein the second sealing element is in direct contact with the center adapter, wherein a length of one of the adapters is greater than a combined length of a rest of the seal assembly.

* * * * *